United States Patent [19]

Wallo

[11] Patent Number: 4,830,197

[45] Date of Patent: May 16, 1989

[54] STANDS FOR DISPLAYING GRAPHIC MATERIALS

[76] Inventor: William H. Wallo, 211 S. Myrtle Ave., Clearwater, Fla. 33516

[21] Appl. No.: 189,067

[22] Filed: May 2, 1988

[51] Int. Cl.[4] ..... A47F 7/14

[52] U.S. Cl. ..... 211/57.1; 40/530

[58] Field of Search ..... 211/57.1, 54.1, 49.1, 211/59.1, 50; 40/530, 379, 382, 383, 119

[56] References Cited

U.S. PATENT DOCUMENTS

| | | | |
|---|---|---|---|
| 735,907 | 8/1903 | Randle | 211/54.1 X |
| 1,229,006 | 6/1917 | Zerwer | 211/50 |
| 1,711,070 | 4/1929 | Suydam, Jr. | 211/59.1 X |
| 1,765,043 | 6/1930 | White | 211/49.1 |
| 2,892,269 | 6/1959 | Pospiszel | 211/57.1 X |
| 3,576,174 | 4/1971 | Topel | 211/59.1 X |
| 4,365,434 | 12/1982 | Doyel | 40/530 |
| 4,399,626 | 8/1983 | Braverman et al. | 40/530 |
| 4,572,379 | 2/1986 | Wallo | 211/57.1 |
| 4,753,411 | 6/1988 | Lechner et al. | 248/DIG. 10 X |
| 4,763,795 | 8/1988 | Metzger et al. | 211/50 X |

*Primary Examiner*—Robert W. Gibson, Jr.
*Assistant Examiner*—Karen J. Chotkowski
*Attorney, Agent, or Firm*—Hill, Van Santen, Steadman & Simpson

[57] ABSTRACT

A display stand for graphic materials display panels has a frame with a supporting structure for the panels. An upstanding handle on the frame is cooperatively related to the supporting structure. A slotted shell keeper device is guided by the upstanding handle for movement into and out of panel retaining position relative to the supporting structure.

20 Claims, 2 Drawing Sheets

STANDS FOR DISPLAYING GRAPHIC MATERIALS

BACKGROUND OF THE PRESENT INVENTION

This invention relates to stands for displaying graphic materials and is more particularly concerned with improvements in stands of the kind disclosed in my U.S. Pat. No. 4,572,379.

Such stands are useful for handling generally flat card-like graphic display panels such as may be used for various record keeping or display purposes, e.g. names and addresses and telephone numbers, sales display or information, recipe files, photographs, and the like.

As disclosed in the aforesaid patent, an arm structure for supporting and assisting in manipulation of the graphic display panels have a panel loading facility comprising a free ended finger arrangement equipped with replaceable stop or retainer terminal tips.

On the other hand, in U.S. Pat. No. 4,399,626, there is disclosed an arrangement in which a cover device with a slotted skirt cooperates with free ends of arms to prevent escape of panels therefrom. However, that cover device is not, as there disclosed, useful on the improved stand disclosed in my U.S. Pat. No. 4,572,379.

SUMMARY OF THE PRESENT INVENTION

A principal object of the present invention is to provide a new and improved keeper for retaining the graphic material display panels on the free ended loading and supporting fingers of the stand of my aforesaid patent, and utilizing a general concept of the slotted skirt but specifically adapted for efficient use with my stand.

Pursuant to the principles of the present invention, there is provided a stand for graphic material display panels of the kind having header perforations, and comprising a frame having rigid elongated structure for replaceably supporting graphic display panels by means of the perforations, an upstanding handle on said frame cooperatively related to the supporting structure, and a keeper device guided by the upstanding handle for movement into and out of panel retaining position relative to the panel supporting rigid elongated structure.

BRIEF DESCRIPTION OF THE DRAWINGS

Other objects, features and advantages of the present invention will be readily apparent from the following detailed description of certain representative embodiments thereof, taken in conjunction with the accompanying drawings, although variations and modifications may be effected without departing from the spirit and scope of the novel concepts embodied in the disclosure, and in which.

DETAILED DESCRIPTION

Figure 1:
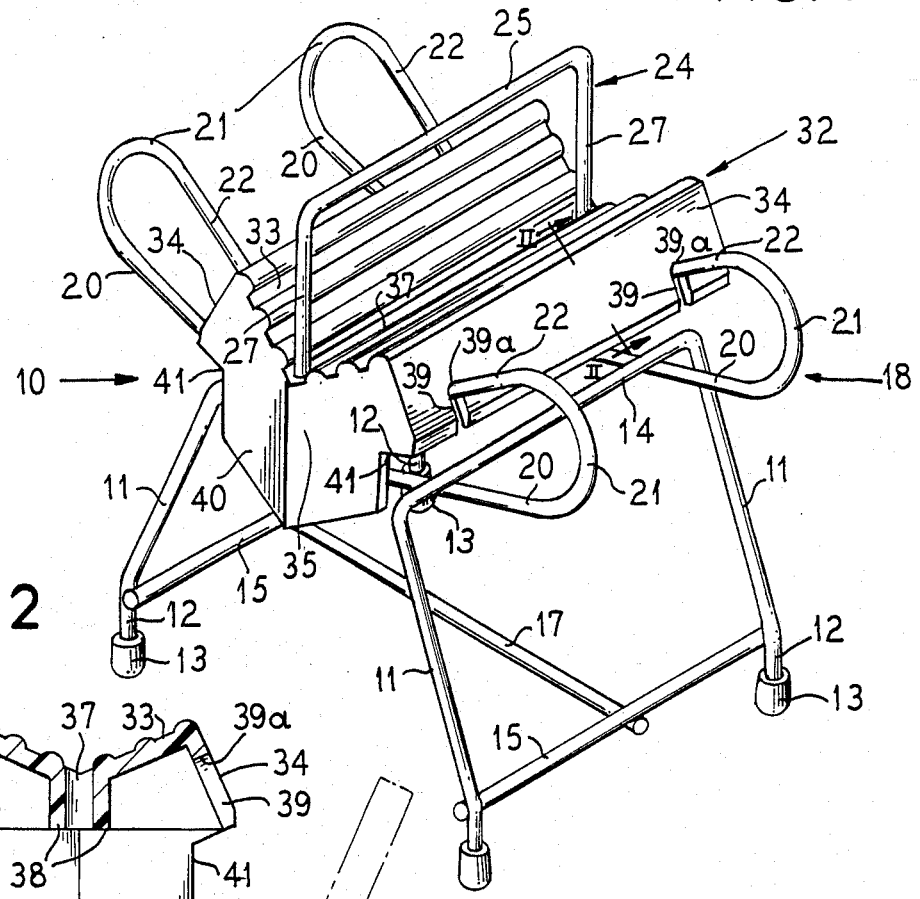
FIG. 1 is a perspective view of a preferred form of display stand embodying the present invention.
Figure 3:
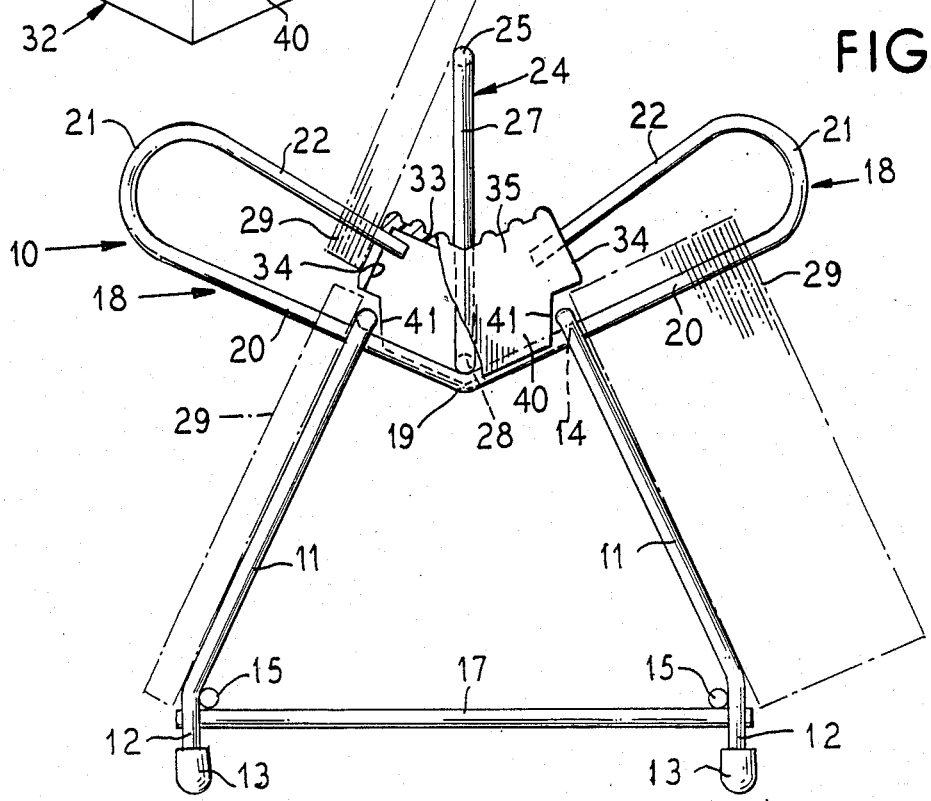
FIG. 3 is a side elevational view of the stand.

Referring to FIGS. 1 and 3, a large capacity display stand 10 for handling graphic material panels may be constructed from heavy wire stock fabricated to provide a stable wireform supporting frame having, in this instance, four spaced generally upright legs 11, each of which has a lower end foot 12 desirably equipped with a non-scuffing pad 13. At their upper ends, the legs 11 are connected by spaced pairs through the medium of respective cross bars 14 in a generally one-piece inverted U-shaped arrangement for stable rigidity. Lower end portions of each pair of the legs 11 are connected together at the upper ends of the feet 12 by means of respective cross bars 15 which may be welded in place. A central front-to-rear truss bar 17 is desirably welded to and between the cross bars 15.

At the upper part of the frame provided by the supporting leg structure and their cross bars 14 are graphic carrying panel supporting means comprising spaced parallel coextensive members 18, each of which, in this instance, comprising a body portion 19 provided with a pair of divergent generally upwardly sloping arms 20 symmetrically secured to the cross bars 14. At distal ends of the arms 20, they are connected by means of respective integral loop smoothly rounded yokes 21 to return directed fingers 22 overlying the arms 20 in vertically spaced relation. Each of the fingers 22 has a free end terminal 23, and as best seen in FIG. 3, the terminals 23 are spaced apart from one another and in spaced relation above the cross bars 14.

Upstanding on the frame, and more particularly supported by the bodies 19 of the panel-supporting members 18, is a manipulating handle structure 24 desirably of generally inverted U-shape having a head cross bar 25 connecting in spaced parallel relation depending legs or posts 27. At their lower ends, the posts 27 have respective horizontal terminal extensions 28 which project toward one another and are fixedly secured to the bodies 19 at juncture of the arms 20.

Figure 4:
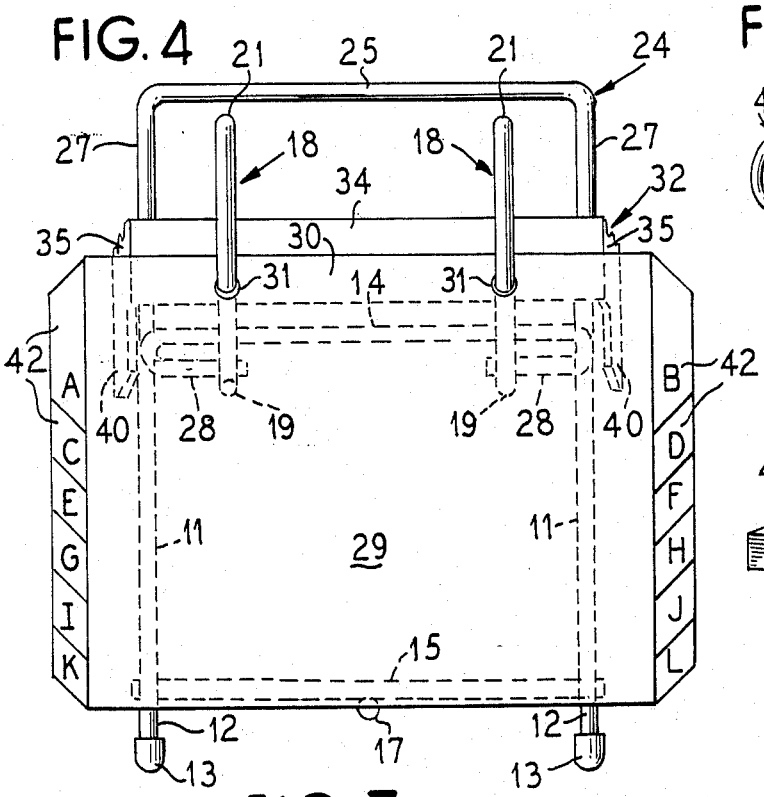
FIG. 4 is a front elevational view of the stand.

Through the arrangement described, a plurality or pack of individual graphic material carrying panels 29 can be supported by the panel supporting members 18 at both the front and the back of the stand 10. As best seen in FIG. 4, each of the panels 29 has a header 30 provided with spaced holes or perforations 31 so that the panels can be loaded onto the supports 28 by threading the panels into place by way of the terminals 23 and then slidably along the fingers 22 and the yokes 21 into suspended relation on the arms 20. In the latter position, the panels 29 are adapted to lie in a generally up-tilted position as seen in FIG. 3 for convenience in viewing graphic material displayed on the front faces of the panels. On the other hand, if it is desired to view graphic material displayed on the back faces of the panels, they may be pulled up onto the fingers 22 and leaned against the handle 24 serving as a tilt rest for this purpose.

Figure 2:
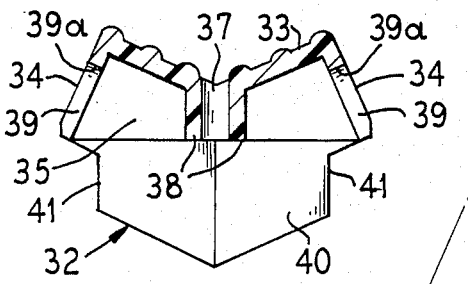
FIG. 2 is a fragmentary sectional detail view taken substantially along the line II—II in FIG. 1.

According to the present invention, a new and improved keeper 32 is provided for retaining the panels 29 against unintentional escape from the generally downwardly convergent fingers 22. In a desirable form, the keeper 32 (FIGS. 1–3) comprises a lightweight shell-like one-piece cast rigid plastic (or equivalent) material molding or casting which is constructed and arranged to be vertically guided by the handle 24 serving as a guide structure for this purpose. The keeper shell has a rib-reinforced top wall 33, similar skirt-like front and rear walls 34, and similar opposite end walls 35. In the top wall 33 is a slot 37 extending from end-to-end of the keeper and dimension to receive the handle 24 in freely slidable relation. Reinforcing ribs or flanges 38 extend downwardly along the slot 37 and are integral with the top wall 33 and the end walls 35.

Each of the keeper front and rear walls 34 has a pair of downwardly opening notches 39 freely receptive of the free terminal end portions of the fingers 22, with upper closed ends 39a of the notches resting on the fingers in the lowermost, keeper position of the keeper member 32. At each side of the stand 10, the ends of the keeper member 32 have depending skirt flange extensions 40 on the end walls 35 depend below the upper sides of the arms 20. Respective end wall front and rear notches 41 clear the adjacent frame areas at juncture of the legs 11 and cross bars 14.

When it is desired to mount panels 29 on the stand, the keeper 32 is removed. The desired number of the panels 29 is threaded onto the carriers or panel supports 18 by maneuvering the panels past the terminals 23 of the fingers 22 and then along the fingers and by way of the yokes 21 into depending supported relation on the arms 20, where the panels 29 will repose facewise against the slanted legs 11. After the desired number of the panels 29 has been mounted on the supports 18, the keeper 32 is replaced and provides a barrier against unintentional escape of the panels 29 from the downwardly slanted fingers 22 when the panels are shifted into an upright position as shown in FIG. 3, wherein the panels lean or rest against the handle 24 and against the respective shoulders provided by the front and/or rear walls 34 of the keeper.

Although as shown in FIGS. 1, 3 and 4, the supports 18 are formed from round wire stock, for some purposes it may be preferred to have the same made from substantially flat wire stock as shown in FIGS. 6–9, to accommodate graphic display panels having horizontally elongated perforations 31', 32''. Any preferred width of the wire stock of the supports 18 may be provided. For example, in FIGS. 6 and 9 the supports 18' have been formed from a relatively narrow width flat wire stock, whereas in FIGS. 7 and 8 the supports 18'' have been formed from a substantially wider flat wire stock.

Figure 6:
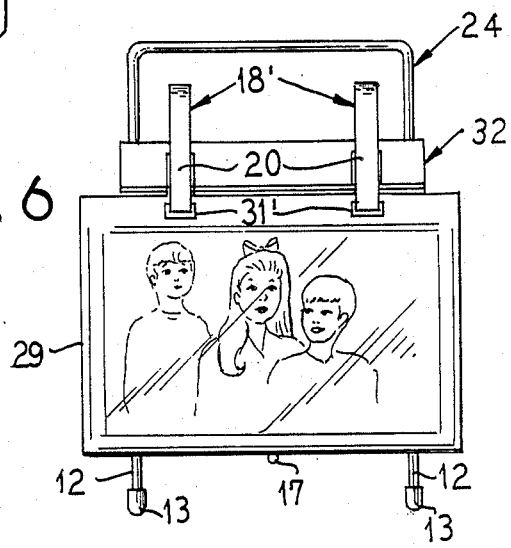
FIG. 6 is a front elevational view of a slightly modified form of the stand.
Figure 7:
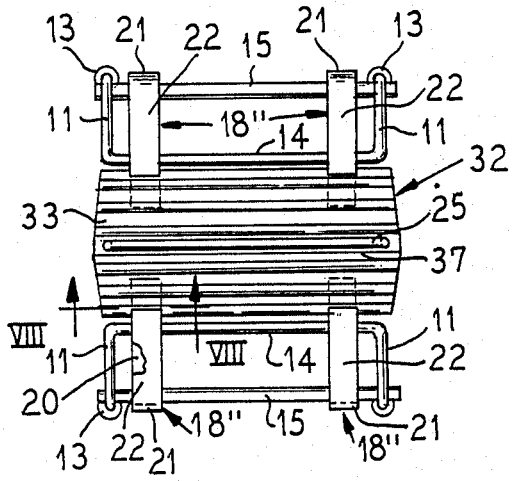
FIG. 7 is a top plan view of the stand in FIG. 6.
Figure 8:
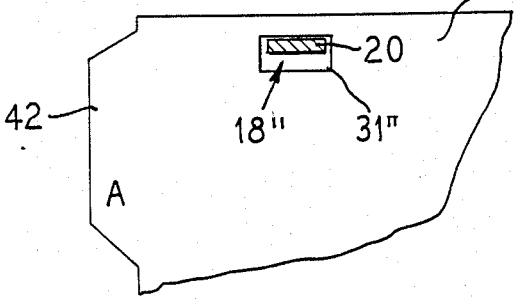
FIG. 8 is a fragmentary enlarged sectional elevational detail view taken substantially along the line VIII—VIII in FIG. 7.
Figure 9:
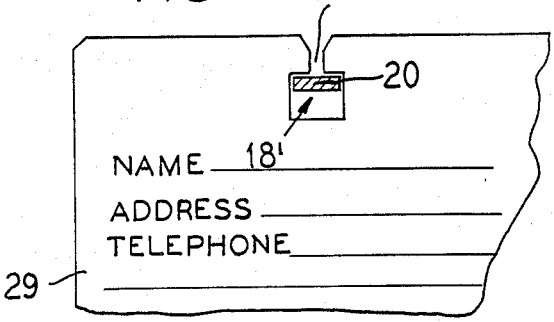
FIG. 9 is a view similar to FIG. 8 but showing a slight modification.

The graphic material carrying panels 29 are all identified by the same reference character, although they may for practical purposes be of different preferred configurations. For example, as shown in FIGS. 4 and 8, the panels 29 are of the type having endwise index tabs 42 which may be only on divider panels, or may be on all of the panels. In FIG. 6, the graphic material display panels 29 may be conventional photo pockets or windows. In FIG. 9, the panels 29 may be add-on information cards, such as adapted to receive names, addresses and telephone numbers in an address card file. Further, the panels 29 in FIG. 9 are representative of information cards of the type having upwardly opening access slots 43 into header perforation holes 31' so that the information panels 29 can be readily vertically removed and replaced with respect to the arms 20 without the necessity of unthreading and rethreading the panels for entry of selective information.

Figure 5:
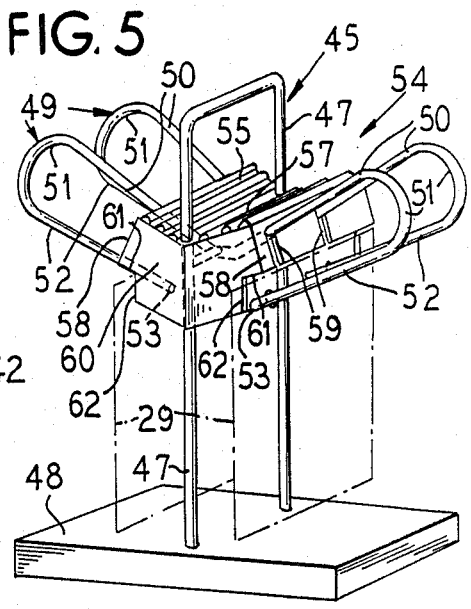
FIG. 5 is a fragmentary perspective view of a modification of the stand.

In FIG. 5, a modified stand 45 comprises an arrangement wherein an upright combination handle, vertical guide and panel rest, generally inverted U-shaped member 47 is supported vertically on a base 48. In this arrangement, graphic material display panel carriers or supports 49 have the arms and fingers reversed compared to FIG. 1. Accordingly, arms 50 are rigidly attached to the uprights of the member 47 and extend on an upward slope to respective rounded connecting yokes 51 leading downwardly onto lower return directed fingers 52 which have their terminals 53 directed generally toward the vertical centrally located structure provided by the handle member 47. Through this arrangement, the graphic material carrying panels 29 are adapted to be mounted on the stand by threading them past the terminals 53 onto the fingers 52. Then, in order to retain the panels against unintentional escape from the fingers 52, a keeper 54 of similar construction as the keeper 32 is slidably mounted on the frame of the stand 45. For this purpose, the keeper 54 has a reenforced top wall 55 provided with a longitudinal slot 57 through which the handle 47 is freely received. Identical front and rear walls 58 have blind end notches 59 for receiving the arms 50 to rest thereon. The walls 58 serve as rest shoulders for the upstanding panels 29 and are generally aligned with the top bar of the handle similarly as the front walls 34 of the keeper 32 in FIGS. 1 and 2. End walls 60 on the keeper 54 may have notches 61 similar to the notches 41 in the keeper 32 of FIGS. 1 and 2. Respective stop shoulders are provided by respective forwardly and rearwardly facing edges 62 on the walls 60 within the notches 61. The stop shoulder edges 62 serve as stops to intercept the panels 29 against escape from the fingers 52.

From the foregoing it will be apparent that the present disclosure provides substantial improvements in the kind of graphic material display stands to which the present invention is directed. A large capacity of graphic carrying panels is provided for. A simple, economical and efficient structure enables easy mounting and removal of graphic material carrying panels. After the panels have been mounted, they are effectively retained against unintentional escape from the supporting structure of the stand by virtue of the novel keeper device of the present invention.

It will be understood that variations and modifications may be effected without departing from the spirit and scope of the novel concepts of the present invention.

I claim as my invention:

1. A stand for graphic material display panels of the kind having header perforations, and comprising:

a frame having rigid elongated structure for replaceably supporting graphic display panels by means of the header perforations;

an upstanding horizontally elongated generally inverted U-shape handle on said frame and toward which said elongated structure generally projects;

a keeper device having a top with a horizontally elongated slot receiving said upstanding handle projecting to a substantial distance upwardly through said slot and said slot having means at its opposite ends for guided movement of said device along said handle and into and out of panel retaining position relative to said elongated structure; and said keeper device being supported on said elongated structure.

2. A stand according to claim 1, wherein said keeper device comprises a rigid plastic member shell having reinforcing ribs along said slot.

3. A stand according to claim 2, wherein said handle comprises a generally inverted U-shaped wireform structure, and said keeper device has a top wall of substantial width with said slot freely slidably receptive of said handle.

4. A stand according to claim 1, wherein said elongated structure comprises fingers on which the panels are adapted to be received by means of the header perforations, said keeper device having notches for receiving said fingers, said notches having surfaces resting on said elongated structure and thereby supporting said keeper device thereon.

5. A stand according to claim 1, wherein said elongated structure comprises wireform fingers having free terminals to be received through the header perforations of the graphic material display panels, and said keeper device having stop shoulder surface means movable into panel blocking position relative to said terminals when in said retaining position, said elongated structure, said stop shoulder surface means and said handle being cooperatively related for mutually supporting said panels in a generally upwardly slanting position leaning against said shoulder surface means and against said handle.

6. A stand according to claim 1, wherein said elongated structure means comprises a wireform construction.

7. A stand according to claim 6, wherein said wireform construction comprises cylindrical wire.

8. A stand according to claim 6, wherein said wireform construction comprises generally flat wire.

9. A stand according to claim 1, wherein said elongated structure is arranged for supporting said panels either hanging down or standing generally upwardly and said keeper device has a panel rest surface slanting upwardly toward and aligned in a plane with the top of said handle, so that when the panels stand upwardly they will rest against said surface and also rest against said handle.

10. A large capacity display stand for graphic material display panels having header holes:

said stand having an upstanding frame provided with an upstanding horizontally elongated handle, and elongated panel supporting structure including arms projecting generally obliquely upwardly away from opposite ends of said handle and having connected thereto by respective return bent transition yokes return directed generally downwardly oblique fingers with free ends by which perforated-header panels are adapted to be threaded into position on said supporting structure;

a keeper device mounted for vertical movement relative to said handle into and out of stop shoulder cooperative relation to said free ends, so that when said keeper device is moved upwardly away from and clear of said fingers, said panels can be maneuvered onto and off of said fingers by way of said free ends and then by replacing the keeper device the panels are retained against escape from the fingers past said free ends; and said keeper device having guide structure cooperating with said opposite ends of the handle for maintaining said keeper device in said cooperative relation to said fingers.

11. A stand according to claim 10, wherein said keeper device comprises a rigid plastic shell having a horizontally elongated slot for receiving said handle, said guide structure being located at opposite ends of said slot, and a reinforcing rib along said slot.

12. A stand according to claim 11, wherein said handle comprises a generally inverted U-shaped wireform structure, and said keeper device has said top wall with a slot freely slidably receptive of said handle.

13. A stand according to claim 10, wherein said supporting structure comprises a wireform construction, and said keeper device comprises a rigid shell construction arranged to rest on and be supported by said wireform construction.

14. A stand according to claim 13, wherein said wireform construction comprises cylindrical wire.

15. A stand according to claim 13, wherein said wireform construction comprises generally flat wire.

16. A large capacity display stand for handling graphic material carried on card-like panels having headers with perforations, and comprising:

a frame having an upstanding handle and at least one panel supporting structure provided with elongate vertically spaced superposed first and second parts of cross section to fit through the header perforations of the graphic display panels;

said first part having an end fixedly attached to said frame;

a free end on said second part spaced from said frame and enabling panels to be mounted on said second part past said free end;

a freely replaceable keeper member relatively movably vertically guided by said handle between a lowered position supported on said supporting structure and a raised position and having stop shoulder means arranged to be moved in said lowered portion into blocking relation to said free end against unintentional escape of display panels mounted on said second part; and said supporting structure, said stop shoulder means and said handle being cooperatively related for mutually supporting said panels in a generally upright position leaning against said shoulder means and also leaning against said handle.

17. A display stand according to claim 16, wherein said keeper member comprises a rigid plastic member having guide means cooperatively related to said handle for enabling guided vertical movement of the keeper member along said handle.

18. A display stand according to claim 17, wherein said handle is horizontally elongated and said guide means on said keeper member comprises a horizontal slot through which said handle is freely received.

19. A stand according to claim 16, wherein said frame, handle and panel supporting structure comprise a wireform construction, and said keeper member comprises a rigid plastic shell having means for guiding the shell along said handle.

20. A stand according to claim 19, wherein said handle is of generally horizontally elongated inverted U-shape, said shell having a horizontally elongated slot receptive of said handle, and reinforcement along said slot.

* * * * *